US009698493B2

(12) United States Patent
Wang et al.

(10) Patent No.: US 9,698,493 B2
(45) Date of Patent: Jul. 4, 2017

(54) DUAL-POLARIZED ANTENNA RADIATING ELEMENT AND BASE STATION ANTENNA

(71) Applicant: HUAWEI TECHNOLOGIES CO., LTD., Shenzhen, Guangdong (CN)

(72) Inventors: Jinju Wang, Shenzhen (CN); Tao Tang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 213 days.

(21) Appl. No.: 14/554,769

(22) Filed: Nov. 26, 2014

(65) Prior Publication Data

US 2015/0084823 A1 Mar. 26, 2015

Related U.S. Application Data

(63) Continuation of application No. PCT/CN2012/076213, filed on May 29, 2012.

(51) Int. Cl.

| | |
|---|---|
| ***H01Q 21/26*** | (2006.01) |
| ***H01Q 1/24*** | (2006.01) |
| ***H01Q 25/00*** | (2006.01) |

(52) U.S. Cl.

CPC ..... *H01Q 21/26* (2013.01); *H01Q 1/247* (2013.01); *H01Q 25/001* (2013.01)

(58) Field of Classification Search

CPC ..... H01Q 21/26; H01Q 1/247; H01Q 25/001

See application file for complete search history.

(56) References Cited

U.S. PATENT DOCUMENTS

| | | | |
|---|---|---|---|
| 6,459,415 | B1 | 10/2002 | Pachal et al. |
| 2007/0229385 | A1 | 10/2007 | Deng et al. |
| 2007/0254587 | A1 | 11/2007 | Schadler et al. |

(Continued)

FOREIGN PATENT DOCUMENTS

| | | |
|---|---|---|
| CN | 101197470 | 6/2008 |
| CN | 101714085 | 5/2010 |

(Continued)

OTHER PUBLICATIONS

Chinese Office Action dated Sep. 4, 2013 and Chinese Search Report dated Aug. 28, 2013 in corresponding Chinese Patent Application No. 201280000717.5.

(Continued)

*Primary Examiner* — Hoang Nguyen
*Assistant Examiner* — Michael Bouizza
(74) *Attorney, Agent, or Firm* — Staas & Halsey LLP

(57) ABSTRACT

Embodiments of the present invention disclose a dual-polarized antenna radiating element. The dual-polarized antenna radiating element includes four radiators and a connecting part, where the four radiators are arranged in a cross shape, with each two of them oppositely disposed, the four radiators form a radiating plane, one end of each of the radiators is connected to the connecting part, and the other end extends in a direction away from the connecting part. Each of the radiators includes a first radiating arm and a second radiating arm, where the first radiating arm and the second radiating arm are asymmetric. In the embodiments of the present invention, a new resonant frequency band is added by using asymmetric radiating arms, thereby broadening the width of a resonant frequency band, so that the antenna radiating element can adapt to a broader resonant frequency band.

11 Claims, 3 Drawing Sheets

(56) References Cited

U.S. PATENT DOCUMENTS

| | | | |
|---|---|---|---|
| 2008/0129640 | A1 | 6/2008 | Shtrom et al. |
| 2010/0290779 | A1 | 11/2010 | Zaacks |
| 2010/0309084 | A1 | 12/2010 | Bu et al. |
| 2013/0187822 | A1 | 7/2013 | Shi et al. |

FOREIGN PATENT DOCUMENTS

| | | |
|---|---|---|
| CN | 101848036 | 9/2010 |
| CN | 102013560 | 4/2011 |
| CN | 102075257 | 5/2011 |
| CN | 102420661 | 4/2012 |
| JP | 4861960 | 1/2012 |
| WO | 2009/056001 A1 | 5/2009 |

OTHER PUBLICATIONS

PCT International Search Report dated Feb. 28, 2013 in corresponding International Patent Application No. PCT/CN2012/076213.
Extended European Search Report dated May 26, 2015 in corresponding European Patent Application No. 12877815.6.
International Search Report, dated Feb. 28, 2013, in corresponding International Application No. PCT/CN2012/076213 (4 pp.).
Search Report mailed Sep. 23, 2014 for corresponding Chinese Patent Application No. 201280000582.2.
Office Action mailed Sep. 30, 2014 for Chinese Patent Application No. 201280000582.2.
PCT Forms PCT/ISA/210 (International Search Report), PCT/ISA/220, and PCT/ISA/237 mailed Apr. 4, 2013 for corresponding International Patent Application No. PCT/CN2012/077761.

DUAL-POLARIZED ANTENNA RADIATING ELEMENT AND BASE STATION ANTENNA

CROSS-REFERENCE TO RELATED APPLICATIONS

This application is a continuation of International Application No. PCT/CN2012/076213, filed on May 29, 2012, which is hereby incorporated by reference in its entirety.

TECHNICAL FIELD

The present invention relates to the field of communications technologies, and in particular to a dual-polarized antenna radiating element and a base station antenna.

BACKGROUND

Dual-polarized antenna radiating elements are widely used in base station antennas. A dual-polarized antenna radiating element is always fed by a coaxial cable. Although balanced feeding can be ensured by using a balun, the size of the balun is related to the frequency, and, it is difficult to ensure the symmetry of a radiation pattern in the case where the size of the balun is not changed.

SUMMARY

According to one aspect, an embodiment of the present invention provides a dual-polarized antenna radiating element, where the dual-polarized antenna radiating element includes four radiators and a connecting part, where:

the four radiators are arranged in a cross shape, with each two of them oppositely disposed, the four radiators form a radiating plane, one end of each of the radiators is connected to the connecting part, and the other end extends in a direction away from the connecting part; and each of the radiators includes a first radiating arm and a second radiating arm, where the first radiating arm and the second radiating arm are asymmetric.

According to another aspect, an embodiment of the present invention provides a base station antenna, which includes a feeding network, a signal input port, and at least one dual-polarized antenna radiating element described above, where:

the feeding network is connected to the dual-polarized antenna radiating element, and is configured to receive a signal from a base station through the signal input port and feed the dual-polarized antenna radiating element, and the dual-polarized antenna radiating element is configured to radiate the signal.

In the embodiments of the present invention, a new resonant frequency band is added by using asymmetric radiating arms, thereby broadening the width of a resonant frequency band, so that the antenna radiating element can adapt to a broader resonant frequency band.

BRIEF DESCRIPTION OF DRAWINGS

To illustrate the technical solutions according to the embodiments of the present invention or in the prior art more clearly, the following briefly introduces accompanying drawings required for describing the embodiments or the prior art. Apparently, the accompanying drawings in the following description are only some embodiments of the present invention, and persons of ordinary skill in the art can obtain other drawings according to the accompanying drawings without paying any creative efforts.

DESCRIPTION OF EMBODIMENTS

The technical solutions in the embodiments of the present invention will be clearly and completely described in the following with reference to the accompanying drawings. It is obvious that the embodiments to be described are only a part rather than all of the embodiments of the present invention. All other embodiments obtained by persons of ordinary skill in the art based on the embodiments of the present invention without creative efforts shall fall within the protection scope of the present invention.

In the embodiments of the present invention, a new resonant frequency band is added by using asymmetric dipole arms, thereby broadening the width of a resonant frequency band, so that a radiator can adapt to a boarder resonant frequency band.

Figure 1:
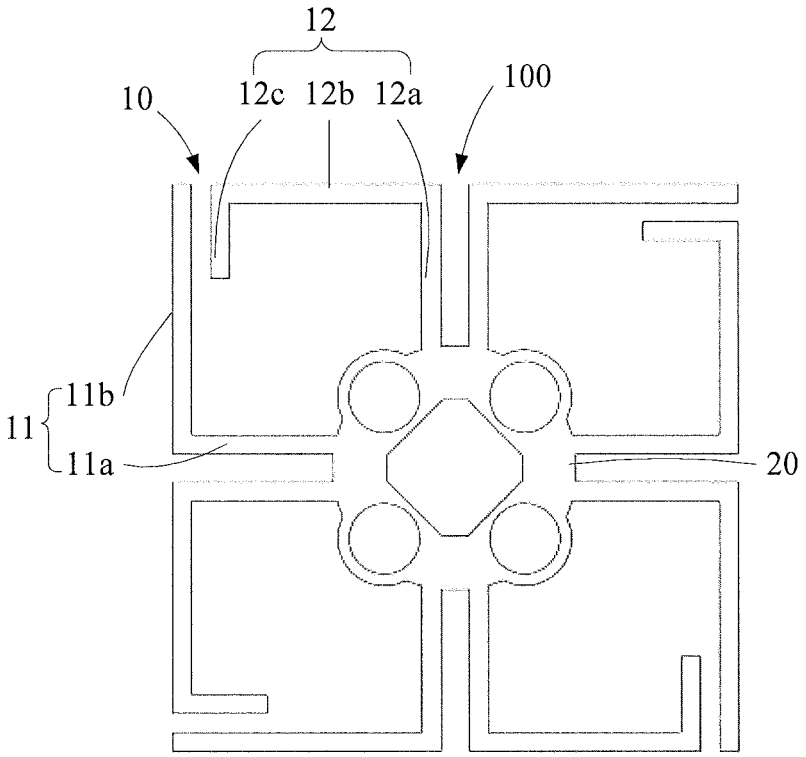
FIG. 1 is a schematic diagram of a first embodiment of a dual-polarized antenna radiating element provided by the present invention.

As show in FIG. 1, an embodiment of the present invention provides a dual-polarized antenna radiating element 100, where the dual-polarized antenna radiating element 100 includes four radiators 10 and a connecting part 20. The four radiators 10 are arranged in a cross shape, with each two of them oppositely disposed, they form a radiating plane, one end of each of the four radiators 10 is connected to the connecting part 20, and the other end extends in a direction away from the connecting part 20. The four radiators 10 may form a centrosymmetric planar 2×2 4-pane window-shaped structure. The connecting part 20 may be in an annular shape. The radiator 10 may be in a rectangular shape. Certainly, in other implementation manners, the radiator 10 may also be in a round shape, a square shape, or other shapes. In this embodiment, the four radiators form a radiating plane, and the four radiators may be centrosymmetric but not axisymmetric on the radiating plane.

The radiator 10 includes a first radiating arm 11 and a second radiating arm 12, where the first radiating arm and the second radiating arm are asymmetric. The first radiating arm 11 includes a first feeding arm 11*a* and a first dipole arm 11*b*, and the first feeding arm 11*a* is connected to the connecting part 20. The first dipole arm 11*b* is perpendicular to the first feeding arm 11*a* and extends towards the second radiating arm 12. The first dipole arm 11*b* and the first feeding arm 11*a* form an L shape and are two right-angle sides of a rectangle formed by the radiators 10. The second radiating arm 12 includes a second feeding arm 12*a*, a second dipole arm 12*b*, and a first bent part 12*c*, where the second feeding arm 12*a* is connected to the connecting part 20. The first feeding arm 11*a* and the second feeding arm 12*a* of two adjacent radiators 10 may be parallel to each other. The second feeding arm 12*a* is perpendicular to the first feeding arm 11*a*, the second dipole arm 12*b* is perpendicular to the second feeding arm 12*a*, the second dipole arm 12*b* extends towards the first dipole arm 11*b*, and the second dipole arm 12*b* and the second feeding arm 12*a* form an L shape and are the other two right-angle sides of the rectangle formed by the radiators 10. The first bent part 12*c* is connected to the second dipole arm 12*b*, extends towards the first feeding arm 11*a*, and may be parallel to the second feeding arm 12*a*. In this embodiment, the first radiating arm 11 and the second radiating arm 12 of the radiator 10 are asymmetric, so that the four radiators 10 may be centrosymmetric but not axisymmetric.

In the prior art, a dual-polarized antenna radiating element is axisymmetric as well as centrosymmetric, and therefore a covered resonant frequency band is single; and the size of a balun is related to the frequency, and therefore it is difficult for the dual-polarized antenna radiating element to adapt to a broader resonant frequency band in the case that the size of the balun is not changed. In this implementation manner, the resonant frequency band covered by a radiator is changed by using asymmetric dipole arms of the radiator, a new resonant frequency band is added, and the width of the resonant frequency band is broadened, so that the radiator can adapt to a broader resonant frequency band. Certainly, the added resonant frequency band may be and may also not be consecutive to the original resonant frequency band.

Alternatively, the first bent part 12*c* of the second radiating arm 12 may also extend in other directions or may be designed into other shapes such as an arc shape, and the first dipole arm 11*a* and the second dipole arm 12*b* may also be in other shapes such as an arc shape provided that they are not axisymmetric.

Figure 2:
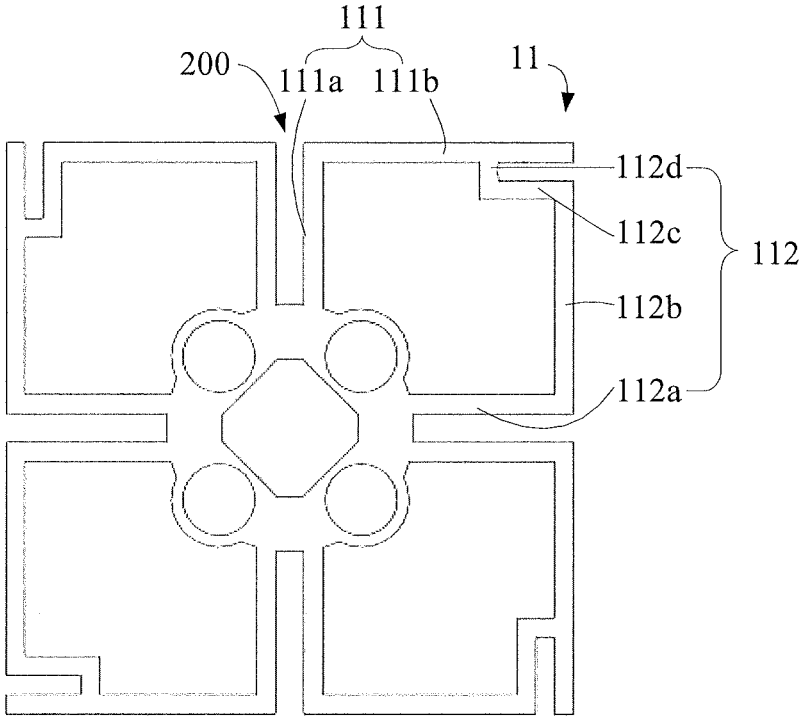
FIG. 2 is a schematic diagram of a second embodiment of a dual-polarized antenna radiating element provided by the present invention.

As shown in FIG. 2, a dual-polarized antenna radiating element 200 provided in another embodiment of the present invention is basically the same as the dual-polarized antenna radiating element 100 provided in the foregoing embodiment. The dual-polarized antenna radiating element 200 includes four radiators 11 and a connecting part. A first radiating arm 111 includes a first feeding arm 111*a* and a first dipole arm 111*b*. A second radiating arm 112 includes a second feeding arm 112*a*, a second dipole arm 112*b* and a first bent part 112*c*. A difference between the dual-polarized antenna radiating element 200 and the dual-polarized antenna radiating element 100 lies in that the second dipole arm 112 further includes a second bent part 112*d*, where the second bent part 112*d* is connected to the first bent part 112*c* of the second radiating arm 112 and the first dipole arm 111*b* of the first radiating arm 111.

In this embodiment, a second bent part is added to a second dipole arm of each radiator and is connected to the first dipole arm, so that two radiating arms of each radiator are asymmetric, the resonant frequency band covered by the radiator is changed, a new resonant frequency band is added, and the width of a resonant frequency band is broadened, so that the a radiator can adapt to a broader resonant frequency band. Certainly, the added resonant frequency band may be and may also not be consecutive to the original resonant frequency band.

Figure 3:
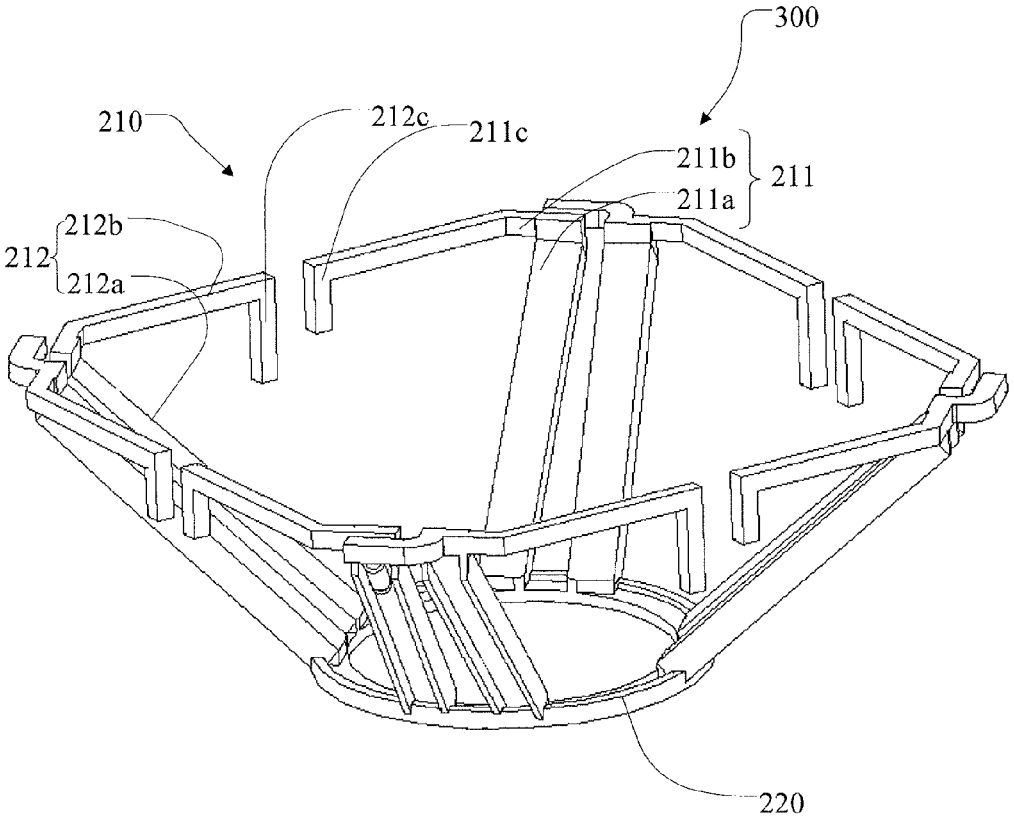
FIG. 3 is a schematic diagram of a third embodiment of a dual-polarized antenna radiating element provided by the present invention.

As shown in FIG. 3, another embodiment of the present invention provides a dual-polarized antenna radiating element 300, which includes four radiators 210 and a connecting part 220, where the four radiators 210 are arranged in a cross shape, with each two of them oppositely disposed, and form a radiating plane. One end of each of the four radiators 210 is connected to the connecting part 220, and the other end extends in a direction away from the connecting part 220. The radiator 210 includes a first radiating arm 211 and a second radiating arm 212. The first radiating arm 211 includes a first feeding arm 211*a* and a first dipole arm 211*b*, the second radiating arm 212 includes a second feeding arm 212*a* and a second dipole arm 212*b*, where the first dipole arm 211*b* and the second dipole arm 212*b* are asymmetric, and the four groups of first dipole arms 211*b* and second dipole arms 212*b* makes a square. In this embodiment, the four radiators form a radiating plane, and the four radiators may be centrosymmetric but not axisymmetric.

The connecting part is located in a first plane, first dipole arm 211*b* and second dipole arm 212*b* of the four radiating elements 210 are located in a second plane parallel to the first plane, the first feeding arm 211*a* and the second feeding arm 212*a* of the dual-polarized antenna radiating element 300 are inclined to the first plane and are respectively connected to the first dipole arm 211*b* and the second dipole arm 212*b*. That is, the first feeding arm 211*a* of the dual-polarized antenna radiating element 300 is connected between the first dipole arm 211*b* and the connecting part 220, the second feeding arm 212*a* is connected between the second dipole arm 212*b* and the connecting part 220, and the multiple groups of first feeding arms 211*a* and second feeding arms 212*a* form a cross cone-shaped structure. The connecting part 220 may be in a ring shape or a square shape.

Certainly, in other implementation manners, the radiator 210 may be in a trapezoid shape, a round shape, or an oval shape. One end of the first feeding arm 211*a* is connected to the connecting part 220, and the other end extends in a direction away from the connecting part 220 along an edge of the cross cone. One end of the first dipole arm 211*b* is connected to the first feeding arm 211*a*, and the other end extends in a direction away from the first feeding arm 211*a* along a base of the cross cone. An end 211*c* of the first dipole arm 211*b* is bent in a manner of being perpendicular to the first dipole arm 211*b* and extends towards the plane where the connecting part 220 is located.

The first feeding arm 211*a* and the second feeding arm 212*a* of two adjacent radiators 210 are arranged side by side. One end of the second feeding arm 212*a* is connected to the connecting part 220, and the other end extends in a direction away from the connecting part 220 along an edge of the cross cone. One end of the second dipole arm 212*b* is connected to the second feeding arm 212*a*, and the other end extends in a direction away from the second feeding arm 212*a* along a base of the cross cone. An end 212*c* of the second dipole arm 212*b* is bent in a manner of being perpendicular to the second dipole arm 212*b* and extends towards the plane where the connecting part 220 is located, and the extension length is greater than the extension length of the end 211*c* of the first dipole arm 211*b*.

Certainly, in other implementation manners, the end 211*c* of the first dipole arm 211*b* and the end 212*c* of the second dipole arm 212*b* may also extend in other directions, or may be designed into an arc shape or a wave shape, or may be transformed at the middle part of the first dipole arm 211*b* and the second dipole arm 212*b*, or may be transformed at a connecting part of the first feeding arm 211*a* and the second feeding arm 212*a*, provided that the four radiators 210 are not axisymmetric.

In this implementation manner, a new resonant frequency band is added by using the first dipole arm and the second dipole arm that are at asymmetric length, thereby broadening the width of the resonant frequency band, so that a radiator can adapt to a broader resonant frequency band.

In addition, in other implementation manners, a new resonant frequency band may also be added by changing the thickness of the first dipole arm and the second dipole arm, thereby broadening the width of the resonant frequency band, so that a radiator can adapt to a broader resonant frequency band.

In the embodiments of the present invention, a new resonant frequency band is added by using axially asymmetric dipole arms, thereby broadening the width of a resonant frequency band, so that a radiator can adapt to a boarder resonant frequency band.

An embodiment of the present invention further provides a base station antenna, which includes a feeding network, a signal input port, and at least one dual-polarized antenna radiating element according to any one of the foregoing embodiments.

The feeding network is connected to the dual-polarized antenna radiating element, and is configured to receive a signal from a base station through an input port and feed the dual-polarized antenna radiating element, and the dual-polarized antenna radiating element is configured to radiate the signal.

In this embodiment, a new resonant frequency band is added by using axially asymmetric dipole arms of a dual-polarized antenna radiating element, thereby broadening the width of a resonant frequency band, so that a base station antenna can adapt to a broader resonant frequency band.

The above descriptions are merely exemplary embodiments of the present invention, but not intended to limit the scope of the present invention. Any equivalent variation made according to the claims of the present invention shall fall within the scope of the present invention.

What is claimed is:

1. A dual-polarized antenna radiating element, comprising:

four radiators; and a connecting part, the connecting part disposed in a first plane, wherein:

the four radiators are arranged in a cross shape, with each two of them oppositely disposed, one end of each of the radiators is connected to the connecting part, the other end extends in a direction away from the connecting part, and the four radiators form a radiating plane, each of the radiators comprises a first radiating arm and a second radiating arm, and the first radiating arm and the second radiating arm are asymmetric with respect to length, and one or a combination of:

(1) the four radiators are symmetric with respect to a 90 degree rotation about an axis perpendicular to the first plane, or (2) an end of the first radiating arm and an end of the second radiating arm are both bent in a direction parallel to the axis perpendicular to the first plane.

2. The dual-polarized antenna radiating element according to claim 1, wherein the four radiators are arranged in a cross shape, the first radiating arm comprises a first feeding arm and a first dipole arm, the second radiating arm comprises a second feeding arm and a second dipole arm, the connecting part is located in a first plane, the first dipole arm and the second dipole arm are located in a second plane in parallel with the first plane, the first feeding arm and second feeding arm are inclined to the plane where the connecting part is located, the first feeding arm is configured to connect the first dipole arm and the connecting part, the second feeding arm is configured to connect the second dipole arm and the connecting part, and four groups of the first feeding arms and the second feeding arms form a cross cone-shaped structure.

3. The dual-polarized antenna radiating element according to claim 2, wherein one end of the first feeding arm is connected to the connecting part and the other end extends in a direction away from the connecting part along an edge of the cross cone, one end of the first dipole arm is connected to the first feeding arm and the other end extends in a direction away from the first feeding arm along a base of the cross cone, an end of the first dipole arm is bent in a manner of being perpendicular to the first dipole arm and extends towards the first plane where the connecting part is located, one end of the second feeding arm is connected to the connecting part and the other end extends in a direction away from the connecting part along an edge of the cross cone, one end of the second dipole arm is connected to the second feeding arm, and the other end extends in a direction away from the second feeding arm along a base of the cross cone, an end of the second dipole arm is bent in a manner of being perpendicular to the second dipole arm and extends towards the first plane where the connecting part is located, and the extension length is greater than the extension length of the end of the first dipole arm.

4. The dual-polarized antenna radiating element according to claim 2, wherein the radiator is in a trapezoid shape, a round shape, or an oval shape.

5. The dual-polarized antenna radiating element according to claim 3, wherein the first feeding arm and the second feeding arm of two adjacent radiators are parallel to each other.

6. The dual-polarized antenna radiating element according to claim 2, wherein the thickness of the first dipole arm is different from that of the second dipole arm.

7. A dual-polarized antenna radiating element, comprising four radiators and a connecting part, wherein:

the four radiators are arranged in a cross shape, with each two of them oppositely disposed, one end of each of the radiators is connected to the connecting part, the other end extends in a direction away from the connecting part, and the four radiators form a radiating plane, each of the radiators comprises a first radiating arm and a second radiating arm, and the first radiating arm and the second radiating arm are asymmetric, and the radiator is in a rectangular shape, the first radiating arm comprises a first feeding arm and a first dipole arm, the first feeding arm is connected to the connecting part, the first dipole arm is perpendicular to the first feeding arm and extends towards the second radiating arm, the first dipole arm and the first feeding arm form an L shape and are two right-angle sides of a rectangle formed by the radiators; the second radiating arm comprises a second feeding arm, a second dipole arm and a first bent part, the second feeding arm is connected to the connecting part, the second feeding arm is perpendicular to the first feeding arm, the second dipole arm is perpendicular to the second feeding arm, the second dipole arm extends towards the first dipole arm, the second dipole arm and the second feeding arm form an L shape and are the other two right-angle sides of the rectangle formed by the radiators, and the first bent part is connected to the second dipole arm and extends towards the first feeding arm.

8. The dual-polarized antenna radiating element according to claim 7, wherein the four radiators form a planar, 2×2 4 pane window-shaped structure, and the first feeding arm and the second feeding arm of two adjacent radiators are parallel to each other.

9. The dual-polarized antenna radiating element according to claim 7, wherein the first dipole arm and the second dipole arm are in an arc shape.

10. The dual-polarized antenna radiating element according to claim 7, wherein the second dipole arm of each of the radiators further comprises a second bent part at an end of the second oscillator arm, and the second bent part is connected to the first bent part and the first dipole arm.

11. A base station antenna, comprising:

a feeding network;

a signal input port; and at least one dual-polarized antenna radiating element, wherein:

the feeding network is connected to the dual-polarized antenna radiating element, and is configured to receive a signal from a base station through the signal input port and feed the dual-polarized antenna radiating element, and the dual-polarized antenna radiating element is configured to radiate the signal;

the dual-polarized antenna radiating element comprises four radiators and a connecting part, the connecting part disposed in a first plane, wherein the four radiators are arranged in a cross shape, with each two of them oppositely disposed, one end of each of the radiators is connected to the connecting part, the other end extends in a direction away from the connecting part, and the four radiators form a radiating plane, each of the radiators comprises a first radiating arm and a second radiating arm, and the first radiating arm and the second radiating arm are asymmetric with respect to length, and one or a combination of:

(1) the four radiators are symmetric with respect to a 90 degree rotation about an axis perpendicular to the first plane, or (2) an end of the first radiating arm and an end of the second radiating arm are both bent in a direction parallel to the axis perpendicular to the first plane.

* * * * *